US010325583B2

(12) United States Patent
Zheng et al.

(10) Patent No.: US 10,325,583 B2
(45) Date of Patent: Jun. 18, 2019

(54) MULTICHANNEL SUB-BAND AUDIO-SIGNAL PROCESSING USING BEAMFORMING AND ECHO CANCELLATION

(71) Applicant: Guoguang Electric Company Limited, Guangzhou (CN)

(72) Inventors: Jimeng Zheng, Shenzhen (CN); Yuli You, Laguna Beach, CA (US)

(73) Assignee: Guoguang Electric Company Limited, Guangzhou (CN)

( * ) Notice: Subject to any disclaimer, the term of this patent is extended or adjusted under 35 U.S.C. 154(b) by 34 days.

(21) Appl. No.: 15/725,217

(22) Filed: Oct. 4, 2017

(65) Prior Publication Data

US 2019/0103088 A1 Apr. 4, 2019

(51) Int. Cl.

| | |
|---|---|
| ***G10K 11/16*** | (2006.01) |
| ***H04R 1/40*** | (2006.01) |
| ***H04R 3/04*** | (2006.01) |

(52) U.S. Cl.

CPC ..... *G10K 11/16* (2013.01); *H04R 1/40* (2013.01); *H04R 3/04* (2013.01)

(58) Field of Classification Search

CPC ..... G10K 11/16; H04R 1/40; H04R 3/04
USPC ..... 381/66, 92; 370/286
See application file for complete search history.

(56) References Cited

U.S. PATENT DOCUMENTS

| | | | | |
|---|---|---|---|---|
| 8,660,274 | B2 * | 2/2014 | Wolff | H04R 3/005 381/92 |
| 2011/0302230 | A1 * | 12/2011 | Ekstrand | H03H 17/0266 708/201 |
| 2012/0243698 | A1 * | 9/2012 | Elko | H04M 9/082 381/66 |
| 2017/0127181 | A1 * | 5/2017 | You | H04R 3/04 |

OTHER PUBLICATIONS

P.P. Vaidyanathan (1993) "Multirate Systems and Filter Banks", Dorling Kindersley, ISBN-13: 978-013605718, pp. 353-391.
Van Trees, H. L. (2002) "Optimum Array Processing", Wiley, NY, pp. 428-452.

* cited by examiner

*Primary Examiner* — Vivian C Chin
*Assistant Examiner* — Douglas J Suthers
(74) *Attorney, Agent, or Firm* — Joseph G. Swan, P.C.

(57) ABSTRACT

Provided are, among other things, systems, methods and techniques for audio-signal processing. One representative embodiment includes HT sub-band analysis/decomposition modules, e.g., one for each audio channel and one for an echo reference signal. Each HT sub-band analysis/decomposition module includes a Hilbert Transformation module and an analysis/decomposition filter bank and provides sub-band outputs. Echo-cancellation modules, e.g., one for each audio channel, perform echo-cancellation processing on such sub-bands. Beamforming modules, e.g., one for each sub-band, then perform beamforming, e.g., across all audio channels. Finally, a resynthesis stage combines the different sub-band outputs in order to provide a system output signal.

16 Claims, 11 Drawing Sheets

MULTICHANNEL SUB-BAND AUDIO-SIGNAL PROCESSING USING BEAMFORMING AND ECHO CANCELLATION

FIELD OF THE INVENTION

The present invention pertains, among other things, to systems, methods and techniques for audio-signal processing and is relevant, e.g., to systems and techniques that process multiple different frequency bands within each of multiple different audio signal channels, and particularly to systems and techniques that attempt to isolate one sound from multiple different sounds that might be present, using such processing.

BACKGROUND

A variety of different audio-signal-processing techniques exist for a variety of different purposes. One such purpose is to remove "echo" and ambient interference signals or "noise" from one or multiple input audio channels, in order to isolate the sound that would be present in the absence of such signals. For example, as smart-speaker devices, such as the Amazon Echo™ device, become popular, far-field voice signal isolation and processing have become more important. Such devices typically include one or more microphones, for receiving spoken input from a user. They also include one or more speakers (1) for responding to, and/or providing information requested by, the user, using text-to-speech (TTS) processing, and/or (2) for playing other audio content, such as music.

Within such a context, it often is desirable to identify what a user is saying at the same time that such other content (e.g., music or TTS) is playing through the device's speaker(s) and/or when other ambient sound sources are creating interference. However, the audio signal received at the device's microphones (i.e., multiple microphones commonly being used) typically contains some version of such other played audio content, in addition to the user's voice.

Conventionally, in order to address this problem, two major signal-processing components of such a system are echo cancellation and beamforming. Echo cancellation (i.e., removal, or at least reduction, of the portion of the received audio signal resulting from the played content) often is critical to the performance of "keyword activation" (KA) and/or speech recognition (ASR) when the smart-speaker device is playing other audio content (e.g. music, TTS responses, etc.). Using sub-band (e.g., frequency-domain) processing, performance (including convergence rate and steady state echo reduction) of echo cancellation (EC) has improved to the point that it often is now able to handle a smart-speaker device's most difficult cases—where the device's speaker is playing loudly and the user is standing far away. Beamforming (which relies on the use of multiple microphones to achieve programmably selective directionality) also can significantly improve KA and ASR performance, particularly in the presence of room reverberation and environmental noise.

An exemplary conventional system 10 is illustrated in FIG. 1. As shown, multiple microphones 12 (e.g., microphones 12A-C) input corresponding audio signals. Each such audio signal (typically after analog-to-digital conversion, not shown) is then decomposed into separate frequency bands using a corresponding analysis/decomposition module 14 (e.g., one of modules 14A-C). A reference signal 15, typically a digital signal corresponding to what is being played through the device's speaker(s), similarly is decomposed into separate frequency bands using an analysis/decomposition module 14 (module 14D in FIG. 1). Each such decomposed input audio signal (from a given microphone) is then processed together with the decomposed reference signal in a separate corresponding echo-cancellation module 18 (e.g., one of modules 18A-C). Next, for each of the subbands, a separate beamformer module 20 (e.g., one of modules 20A-C) processes the output for that subband from all of the echo-cancellation modules 18. The individual frequency bands output by the corresponding individual beamformer modules 20 are then resynthesized by subband resynthesis module 24 to provide a final output signal 25.

The signals input by the individual microphones 12 are denoted herein as $x_i(t)$, i=1, . . . , N, where N is the number of microphones. The echo reference signal is denoted herein as r(t). Both $x_i(t)$ and r(t) are processed by the sub-band analysis/decomposition modules 14, which processing typically includes D times down-sampling. The outputs of the analysis/decomposition modules are denoted herein as $x_{i,m}^{D}(t)$ and $r_m^{D}(t)$, m=1, . . . , M, where M is the number of sub-bands. As indicated above, each microphone's echo cancellation is done independently in a separate echo-cancellation module 18 (e.g., one of modules 18A-C). Each such echo-cancellation module 18, in turn, typically includes M sub-band EC submodules (not shown). The EC signals output from the echo-cancellation modules 18 are denoted herein as $\hat{x}_{i,m}^{D}(t)$, i=1, . . . , N, m=1, . . . , M. Following the EC processing 18, the beamforming 20 is done in each sub-band independently. That is, each beamformer module 20 processes a different sub-band across all the EC-processed microphone signals.

Each sub-band's beamforming can be done as if in the time domain, i.e. filter-and-sum. Another option is to first conduct a Fast Fourier Transform (FFT) analysis in each sub-band and then do beamforming in each bin, followed by inverse Fast Fourier Transform (iFFT) processing, so that a sub-band signal stream is again obtained. The outputs of the beamforming modules 20, designated herein as $z_m(t)$, m=1, . . . , M, are input into the sub-band resynthesis module 24, which generates the system's output signal 25, designated herein as y(t).

SUMMARY OF THE INVENTION

The present inventors have discovered that the down-sampling within the sub-band analysis/decomposition modules 14 often will introduce frequency aliasing in some or all of the sub-bands. Such aliasing can cause significant performance degradation in the beamformer 20 because, in the overlapped frequencies, both phase and magnitude information are disturbed.

The present invention addresses this problem by, among other things, providing a new sub-band analysis/decomposition structure that can reduce frequency aliasing, often with moderate to no increase in computational complexity.

Thus, one embodiment of the invention is directed to an audio-signal-processing system which includes HT sub-band analysis/decomposition modules, each including (a) a Hilbert Transformation module having an input and an output that provides a Hilbert Transformed version of a signal at the input of the Hilbert Transformation module; and (b) an analysis/decomposition filter bank having (i) an input coupled to the output of the Hilbert Transformation module and (ii) a number of outputs, each providing a different frequency sub-band for a signal provided at the input of the analysis/decomposition filter bank. The system also includes echo-cancellation modules, each having (i) a first set of sub-band inputs coupled to corresponding sub-band outputs of a different one of the HT sub-band analysis/decomposition modules, (ii) a second set of sub-band inputs coupled to corresponding sub-band outputs of a common one of the HT sub-band analysis/decomposition modules, and (iii) outputs that provide such sub-bands after echo-cancellation processing. For each of a number of beamforming modules, each of the inputs of such beamforming module are coupled to the same sub-band output from different echo-cancellation modules, and the output of such beamforming module provides that sub-band after beamforming. A resynthesis stage has inputs coupled to the different sub-band outputs of the different beamforming modules and resynthesizes such different sub-band outputs in order to provide a system output signal.

Another embodiment is directed to an audio-signal-processing system which includes two HT sub-band analysis/decomposition modules, each including (a) a Hilbert Transformation module having an input and an output that provides a Hilbert Transformed version of a signal at the input of the Hilbert Transformation module; and (b) an analysis/decomposition filter bank having (i) an input coupled to the output of the Hilbert Transformation module and (ii) a number of outputs, each providing a different frequency sub-band for a signal provided at the input of the analysis/decomposition filter bank. The first one of the HT sub-band analysis/decomposition modules inputs an audio signal (e.g., from a microphone) and a second one inputs an echo reference signal. An echo-cancellation module, includes (i) a first set of sub-band inputs coupled to the sub-band outputs of the first HT sub-band analysis/decomposition module, (ii) a second set of sub-band inputs coupled to corresponding sub-band outputs of the second HT sub-band analysis/decomposition module, and (iii) outputs that provide such sub-bands after echo-cancellation processing. A resynthesis stage has inputs coupled to the different sub-band outputs of the echo-cancellation module and resynthesizes such different sub-band outputs in order to provide a system output signal.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the accompanying drawings. However, it should be understood that the drawings merely depict certain representative and/or exemplary embodiments and features of the present invention and are not intended to limit the scope of the invention in any manner. The following is a brief description of each of the accompanying drawings.

DESCRIPTION OF THE PREFERRED EMBODIMENT(S)

Where the discussion below refers to or indicates the time domain, it should be understood that such references or indications can encompass either continuous or sampled time. For example, the notation $f(t)$ should be construed to mean that the indicated function $f$ is in the time domain, which could be continuous or sampled time. In some cases, the current preference for a particular step, component, operation or function in the described embodiment is indicated by the context or by other portions of the description. However, no loss of generality is intended. That is, for example, even when a particular description indicates that a signal includes, or processing operates on, discrete time samples, in alternate embodiments, the signal or processing, as applicable, is in continuous time, and vice versa.

Figure 1:
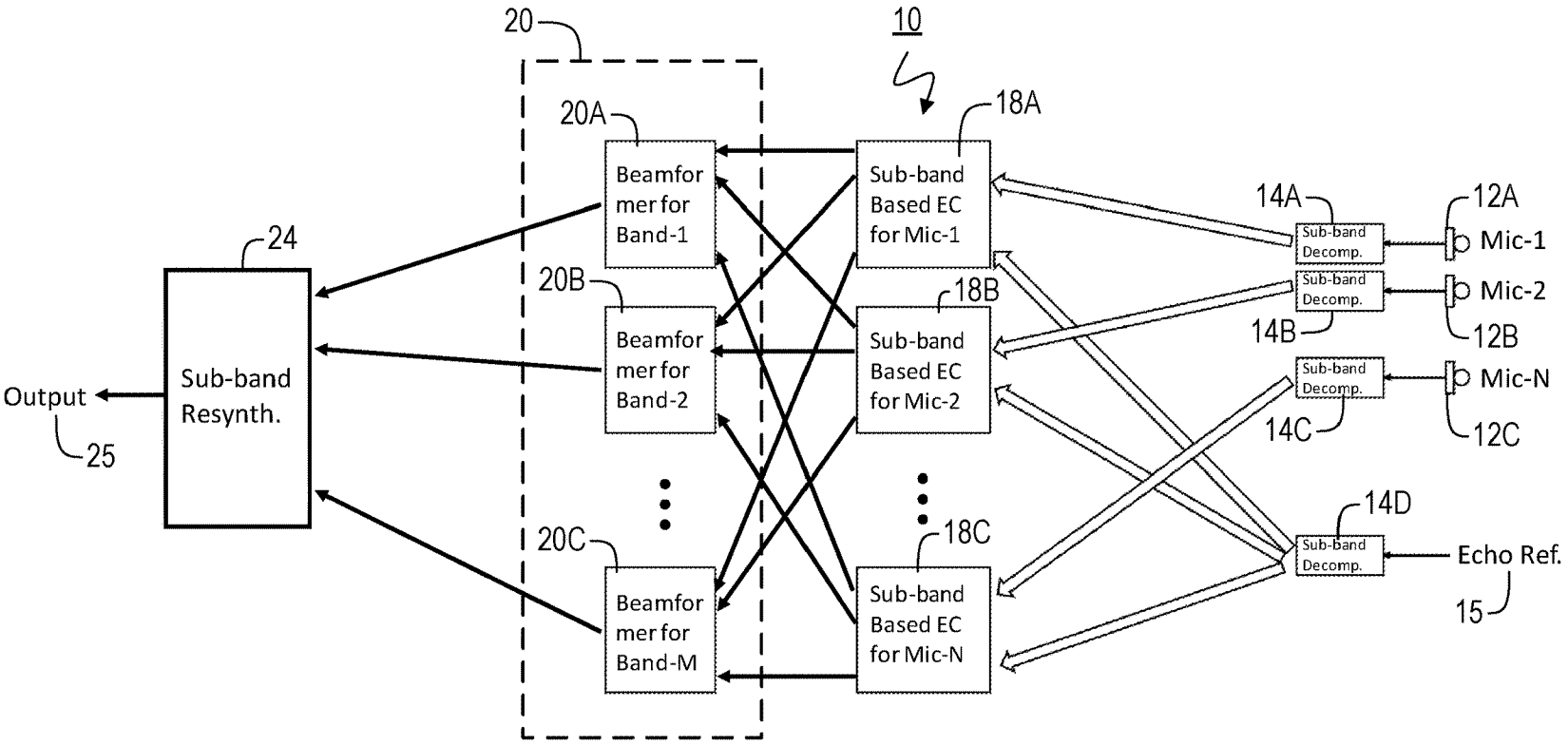
FIG. 1 (Prior Art)
FIG. 1 is a block diagram of a conventional multichannel subband-based audio signal processing system.
Figure 2:
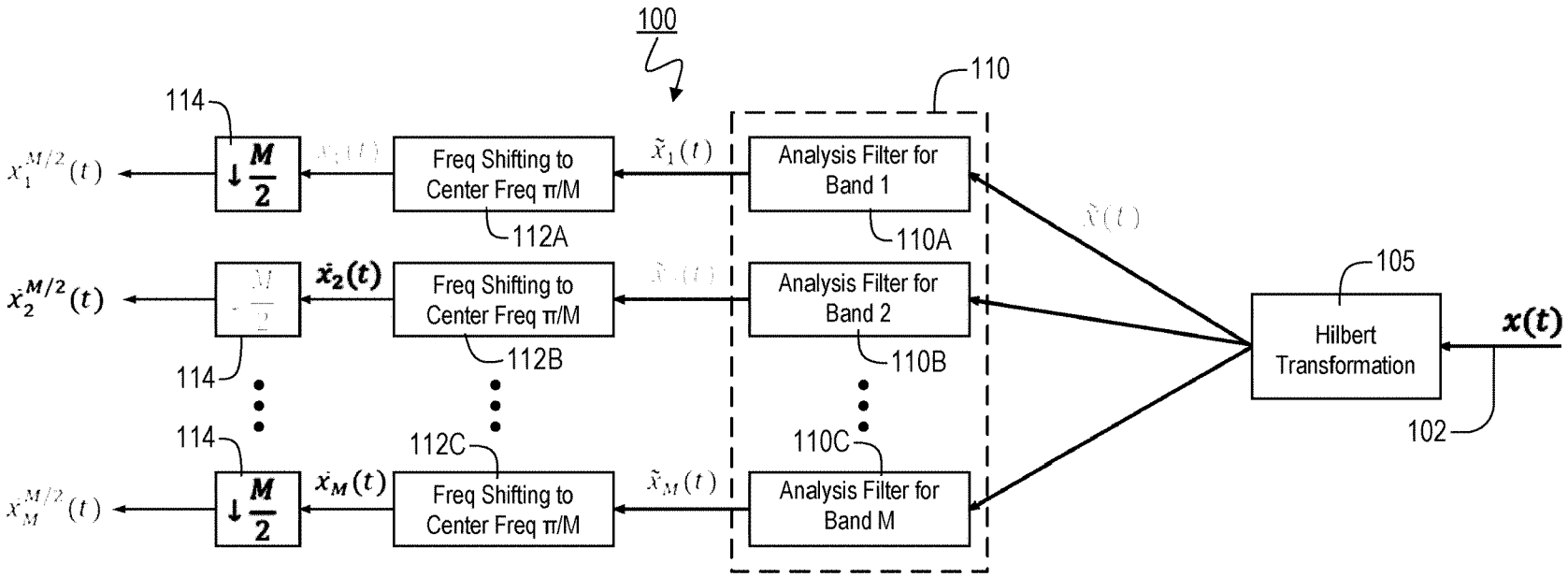
FIG. 2 is a block diagram of a HT sub-band analysis/decomposition module according to a representative embodiment of the present invention.

FIG. 2 illustrates the structure of a HT sub-band analysis/decomposition module 100 according to an initial representative embodiment of the present invention. Sub-band analysis/decomposition modules 100 can replace the analysis/decomposition modules 14 shown in FIG. 1, allowing changes to other components of the system 10, e.g., as discussed in greater detail below.

Figure 3:
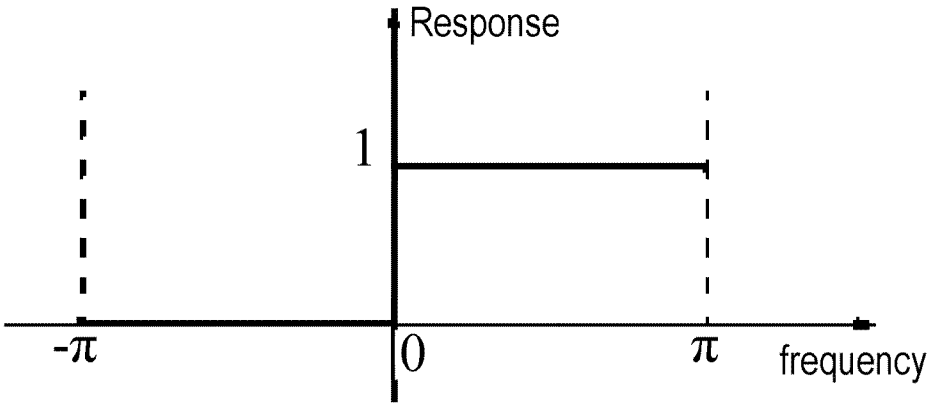
FIG. 3 shows the frequency response of a Hilbert Transformation module.

Initially, an input signal $x(t)$ is provided on the input line 102 of the Hilbert Transformation module 105, which performs the Hilbert Transformation on input signal $x(t)$ and thereby removes the negative frequency components from it. As a result, the output $\tilde{x}(t)$ of the Hilbert Transformation module 105 is a complex signal (having real and imaginary or in-phase and quadrature components). FIG. 3 shows the frequency response of the Hilbert Transformation module 105.

Figure 4:
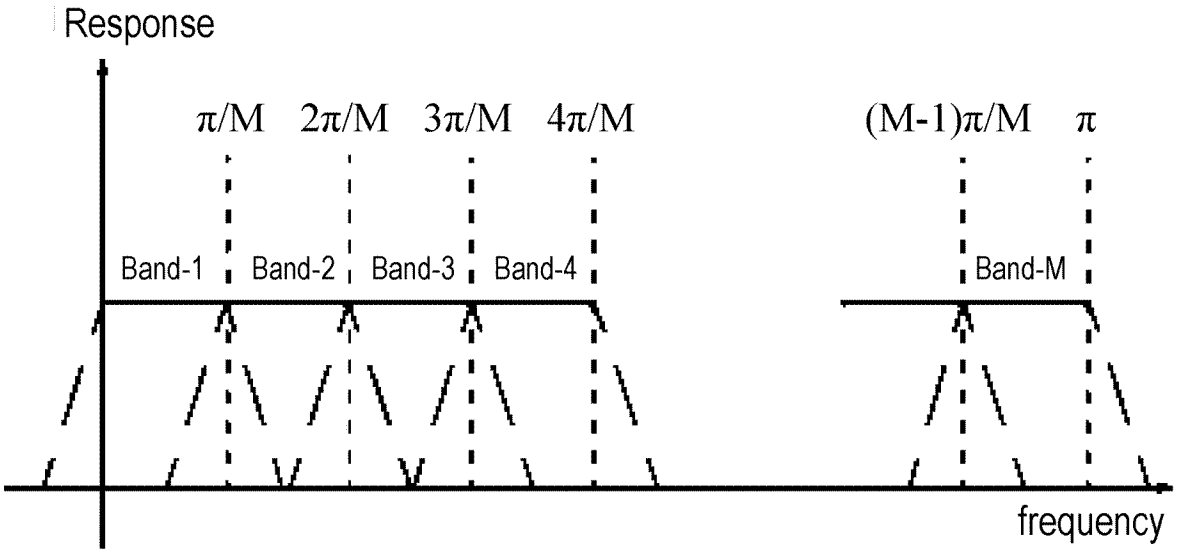
FIG. 4 shows a simplified version of the frequency spectra of the sub-band signals produced by a filter bank.

The output of the Hilbert Transformation module 105 is coupled to the input of analysis/decomposition filter bank 110, which preferably includes a set of M individual bandpass filters (e.g., filters 110A-C). Such bandpass filters can be implemented, e.g., as conventional Quadrature Mirror Filters (QMFs), as described in P. P. Vaidyanathan (1993) "Multirate Systems And Filter Banks", Dorling Kindersley, ISBN-13: 978-013605718, with contiguous frequency passband responses, i.e., using a filter bank that is conventionally used for the present purposes. In other words, module 105 output signal $\tilde{x}(t)$ (with or without any additional intermediate processing) is then processed by the analysis/decomposition filter bank 110. Preferably, the corresponding output signals, $\tilde{x}_m(t)$, m=1, . . . , M, are still at the same sampling rate as the original input signal x(t), which is denoted herein as sampling rate R. In the current embodiment, the frequency spectra of the sub-band signals $\tilde{x}_m(t)$ are shown conceptually in FIG. 4 (e.g., with simplified roll-offs). Preferably, all the M sub-bands (i.e., the bands of the individual bandpass filters) have the same frequency width. As shown in FIG. 4, each sub-band has leakage into its two neighboring bands, which is the root-cause of the frequency aliasing mentioned in the Summary of the Invention section, above, and which causes problems, e.g., in beamforming.

Figure 5:
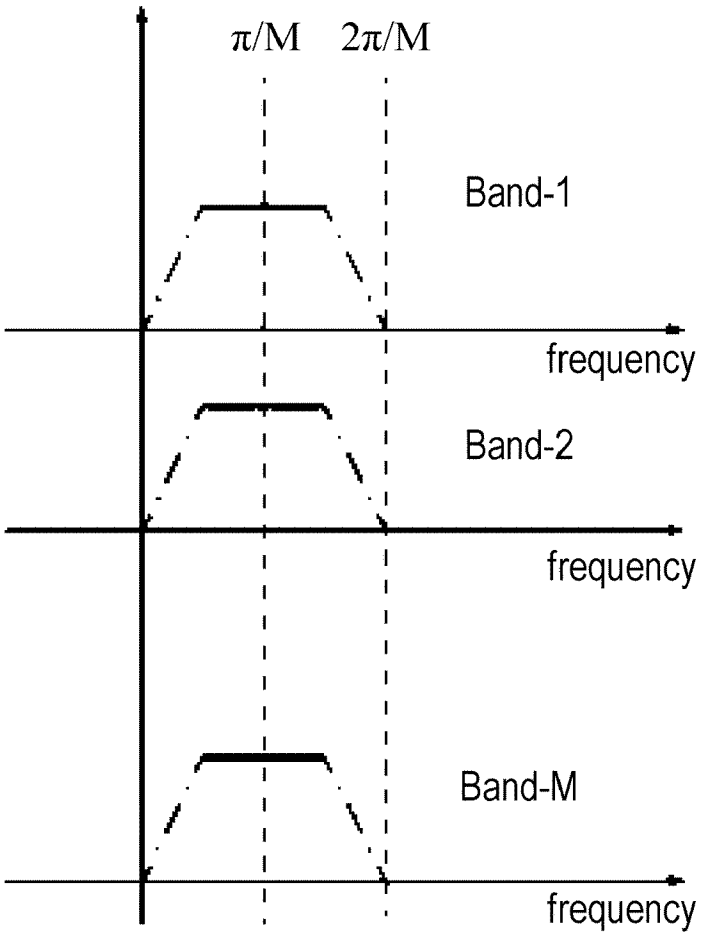
FIG. 5 shows a simplified version of the frequency spectra of the sub-band signals after frequency shifting.

Each of the outputs of the analysis/decomposition filter bank 110 (i.e., each $\tilde{x}_m(t)$) is coupled to the input of a frequency-shifting module 112 (e.g., one of modules 112A-C), which shifts the corresponding signal $\tilde{x}_m(t)$ so that its center frequency is π/M. More preferably, each such module 112 implements $$\bar{x}_m(t) = \tilde{x}_m(t) * e^{j(\frac{\pi}{M} - \frac{(2m-1)\pi}{2M})t},$$

with $\bar{x}_m(t)$ being the output of the module 112, $f_0=\pi/M$ being the new center frequency and $f_m=(2m-1)\pi/2M$, m=1, . . . , M being the original center frequency. As a result, the frequency spectra of the $\bar{x}_m(t)$ now appear as shown (again, in simplified form) in FIG. 5.

The output of each frequency-shifting module 112 is coupled to the input of a down-sampling module 114 which preferably performs M/2 down-sampling (e.g., using decimation, averaging or any other conventional technique), thereby providing output signals $\bar{x}_m^{M/2}(t)$. The frequency spectra of such output signals $\bar{x}_m^{M/2}(t)$ are shown (again, in simplified form) in FIG. 6. For simplicity, the following discussion sometimes refers to output signals $\bar{x}_m^{M/2}(t)$ as $u_m(t)$. That is, $u_m(t)=\bar{x}_m^{M/2}(t)$.

Figure 7A:
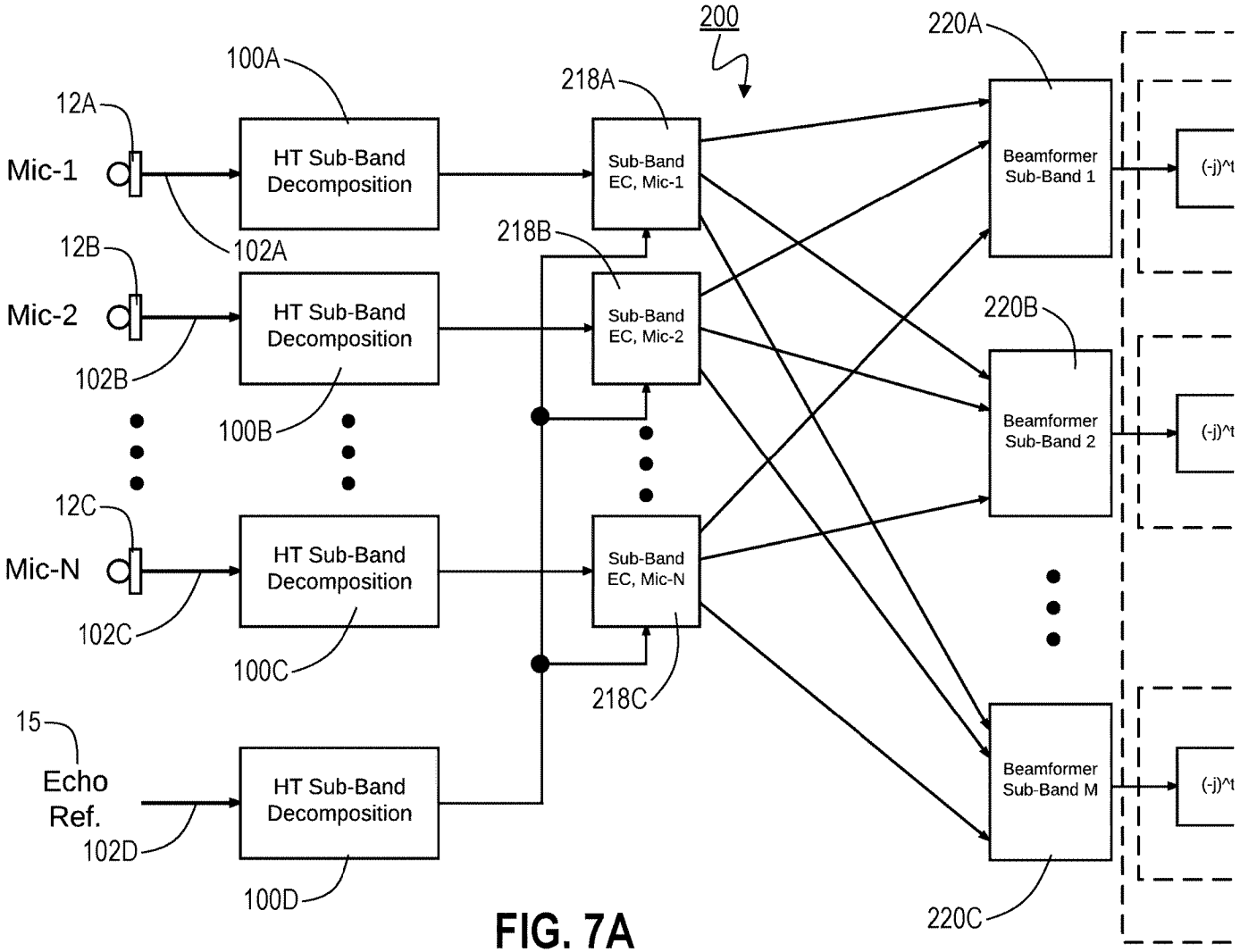
FIG. 7, divided into FIGS. 7A&B in order to more clearly show the individual components, is a block diagram of a system according to the present invention that includes Hilbert-Transformation sub-band analysis/decomposition modules.
Figure 7B:
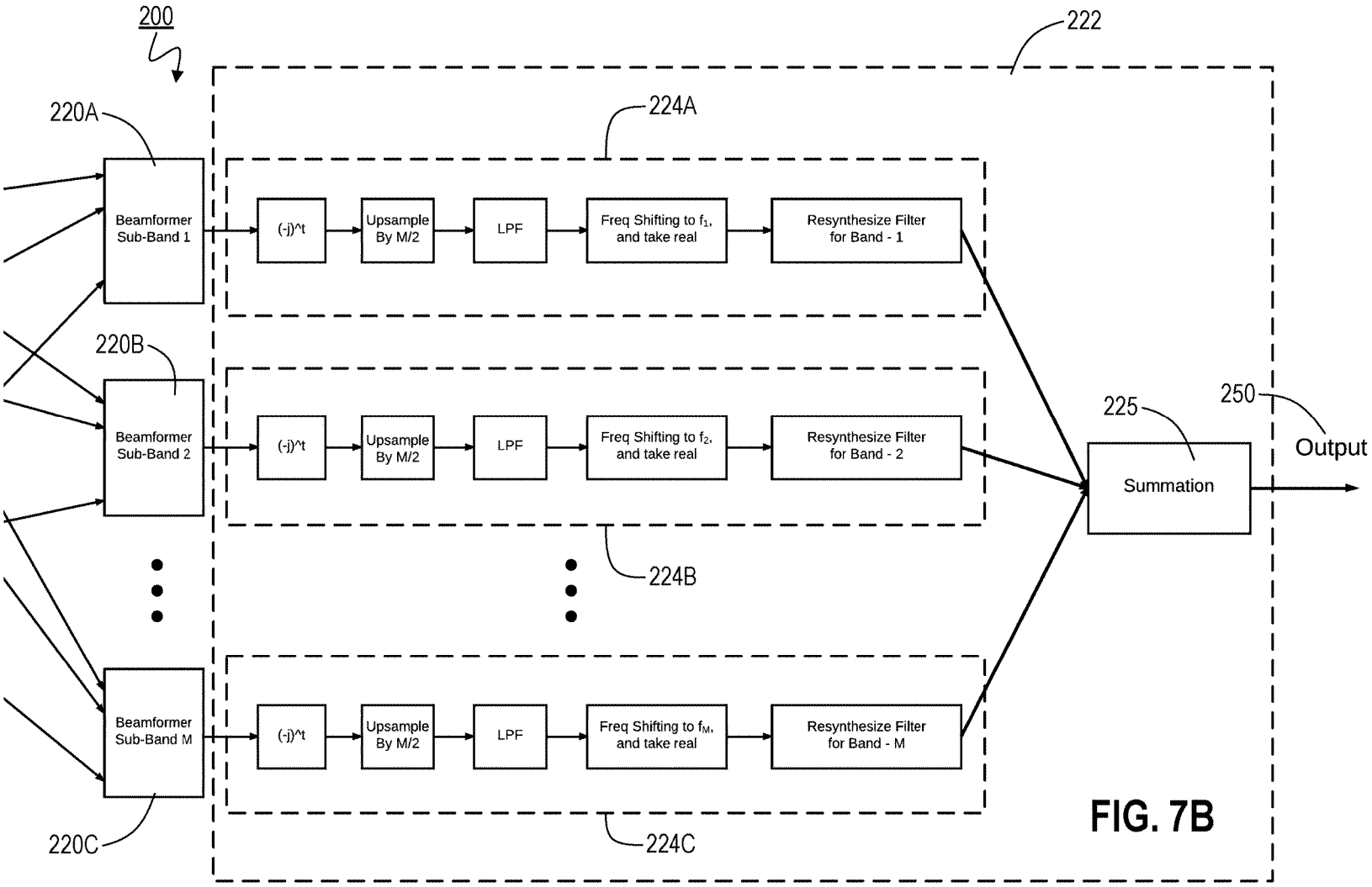

A system 200 that includes such Hilbert-Transformation sub-band analysis/decomposition modules 100 (e.g., modules 100A-D) is illustrated in FIG. 7. As shown, the audio signal from each of a plurality of microphones 12 (e.g., microphones 12A-C) is coupled to the input line 102 (e.g., the corresponding one of input lines 102A-C) of a different Hilbert-Transformation sub-band analysis/decomposition module 100 (e.g., one of modules 100A-C). In addition, the input line 102D of one of the Hilbert-Transformation sub-band analysis/decomposition modules 100 (module 100D in the present example) is coupled to echo reference signal 15 which preferably represents, or at least corresponds to, an audio signal that is being output by the speaker(s) of a device of which system 200 also is a part.

The first set of inputs of each echo-cancellation module 218 (e.g., one of modules 218A-C) is coupled to the outputs of a microphone-signal-processing Hilbert-Transformation sub-band analysis/decomposition module 100 (e.g., one of modules 100A-C). That is, each such echo-cancellation module 218 preferably inputs the sub-band signals from a different one of the microphones 12 (following such Hilbert-Transformation sub-band analysis/decomposition and, optionally, any other desired processing). In addition, a second set of inputs of each such echo-cancellation module 218 is coupled to the outputs of a common Hilbert-Transformation sub-band analysis/decomposition module, e.g., module 100D that processes the echo reference signal 15.

Figure 6:
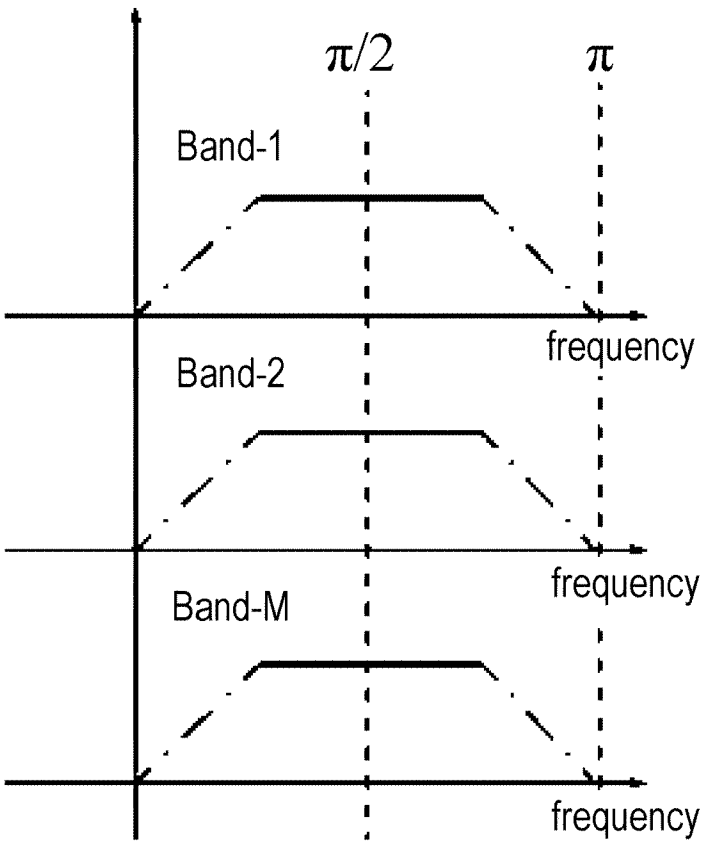
FIG. 6 shows a simplified version of the frequency spectra of the sub-band signals after down-sampling.

As shown in FIG. 6, the signals $u_m(t)$ output by modules 100A-D do not contain negative frequency components. Therefore, when such signals are EC processed in modules 218, the negative-frequency response can be ignored. As a result, the EC transfer function of each such module 218 preferably is implemented using only real numbers. Otherwise, echo cancellation, as performed by modules 218, can be implemented, e.g., as discussed in commonly assigned U.S. patent application Ser. No. 15/704,235, which application is incorporated by reference herein as though set forth herein in full, or using a conventional EC approach.

The sub-band outputs of the EC modules 218 are coupled to the inputs of beamformer modules 220 (e.g., modules 220A-C), with the same sub-band across all the EC modules 218 being input to the same beamformer module 220, e.g., with each beamformer module 220 processing a particular sub-band that has been received from all the EC modules 218 and with all the beamformer modules 220 collectively processing all of the corresponding sub-bands. For instance, beamformer module 220A might process the sub-band 1 outputs from all the EC modules 218, while beamformer module 220B processes the sub-band 2 outputs from all the EC modules 218, and beamformer module 220C processes the sub-band 3 outputs from all the EC modules 218. In the beamformer modules 220, as in the EC modules 218, beamforming preferably is performed only in the positive frequency range. Otherwise, any conventional beamforming technique may be used. The currently preferred technique is Minimum Variance Distortionless Response (MVDR) Beamformer, as described in Van Trees, H. L. (2002) "Optimum Array Processing", Wiley, N.Y. If beamforming is performed as filter-and-sum, savings can be achieved by using only real-valued filter coefficients. On the other hand, if beamforming is implemented with FFT, e.g., then savings can be achieved by only conducting beamforming processing only in the lower half of the bins. In the present discussion, the output signals of beamforming modules 220 are designated as $v_m(t)$, m=1, . . . , M.

Figure 8A:
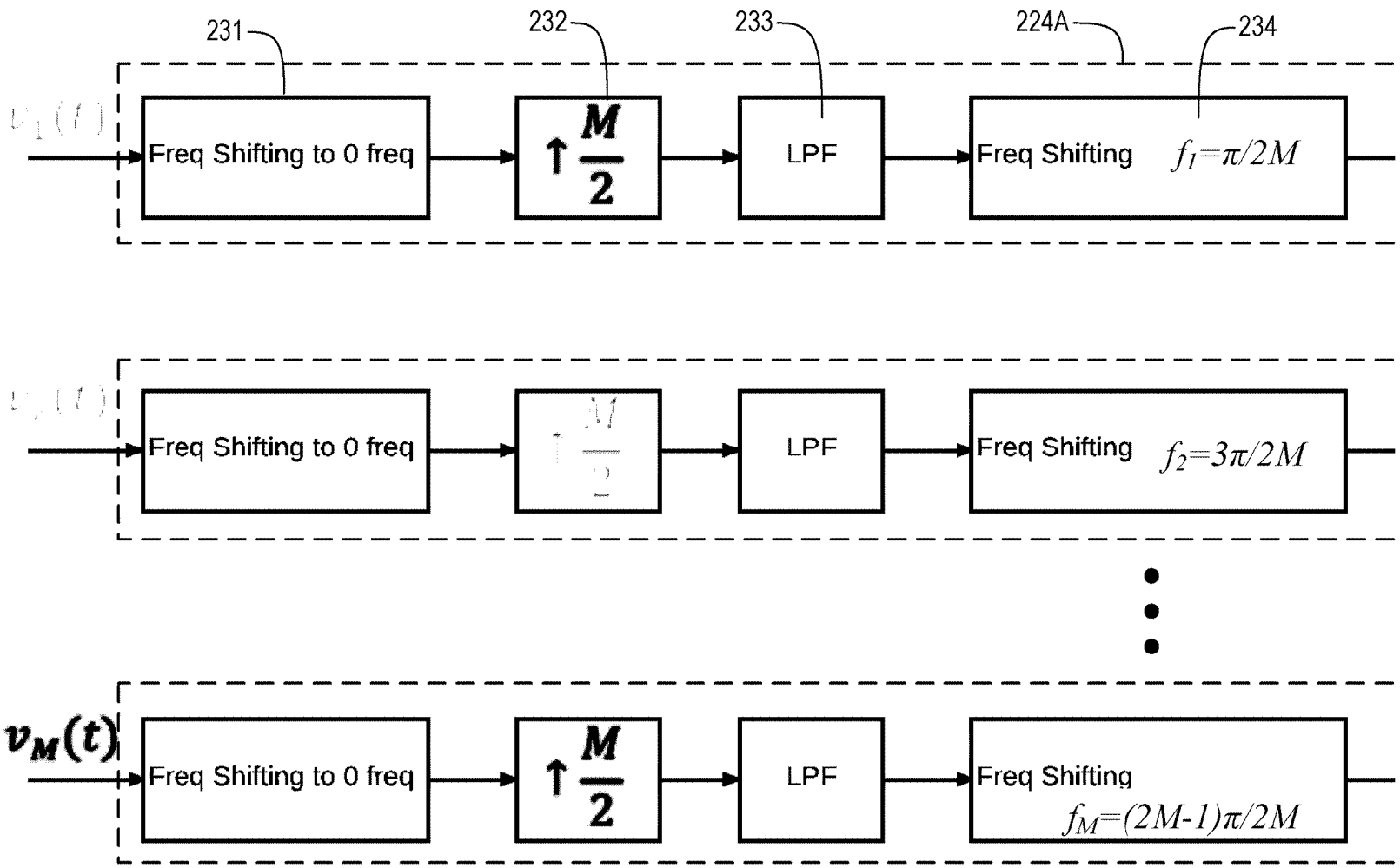
FIG. 8, divided into FIGS. 8A&B in order to more clearly show the individual components, is a block diagram of the resynthesis stage of the system shown in FIG. 7.
Figure 8B:
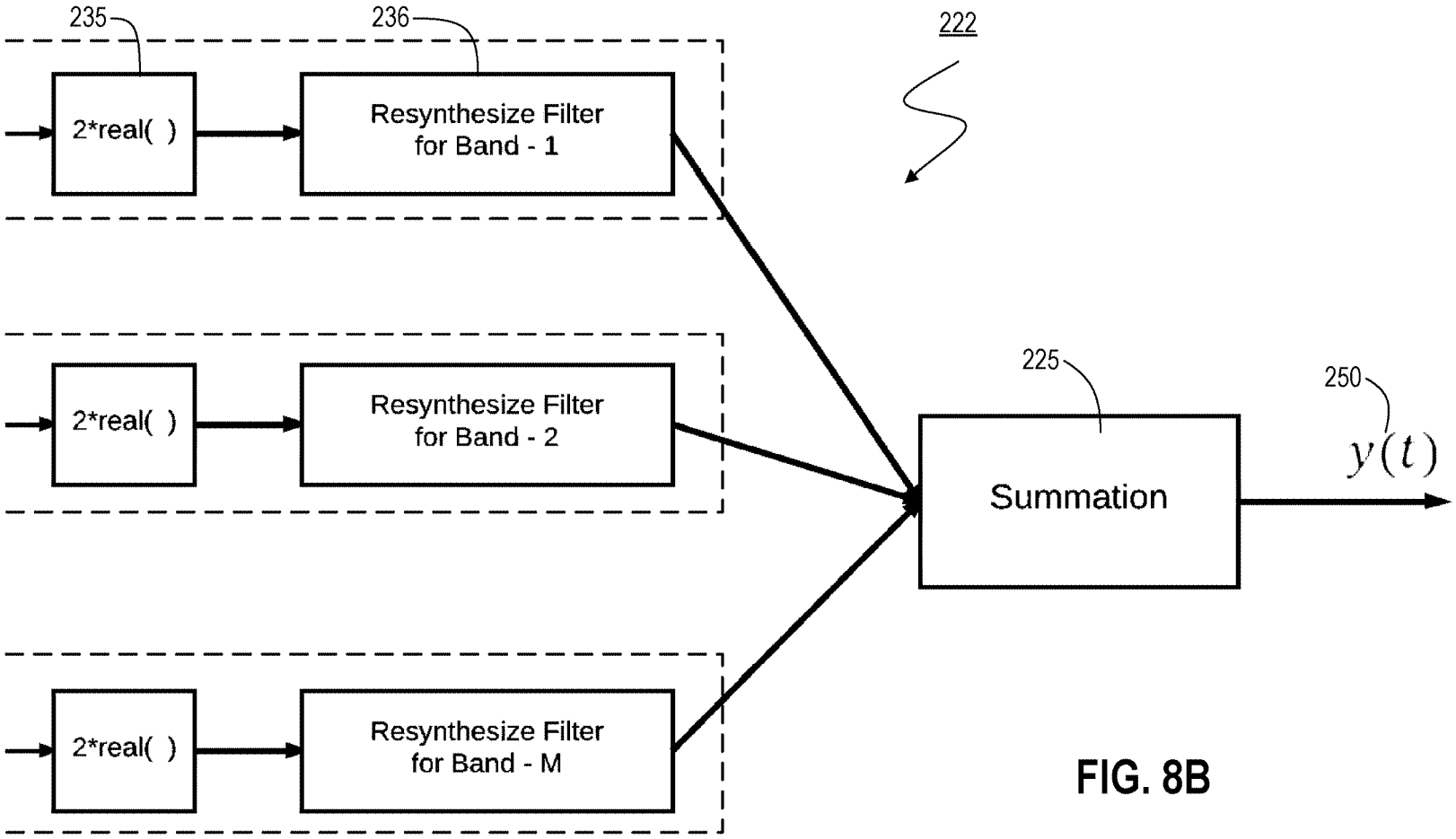

Because of the previous M/2 down-sampling 114, discussed above, special care preferably is made in the resynthesis stage 222, which includes individual sub-band resynthesis modules (e.g., modules 224A-C) and adder 225. An exemplary embodiment of the resynthesis stage 222 is shown in greater detail in FIG. 8. The present discussion primarily refers to just one of the resynthesis modules, module 224A. However, the discussion also is generalized (e.g., by referring to sub-band m) in order to apply to any of the M resynthesis modules (e.g., modules 224A-C), processing any of the corresponding M sub-bands.

Figure 9:
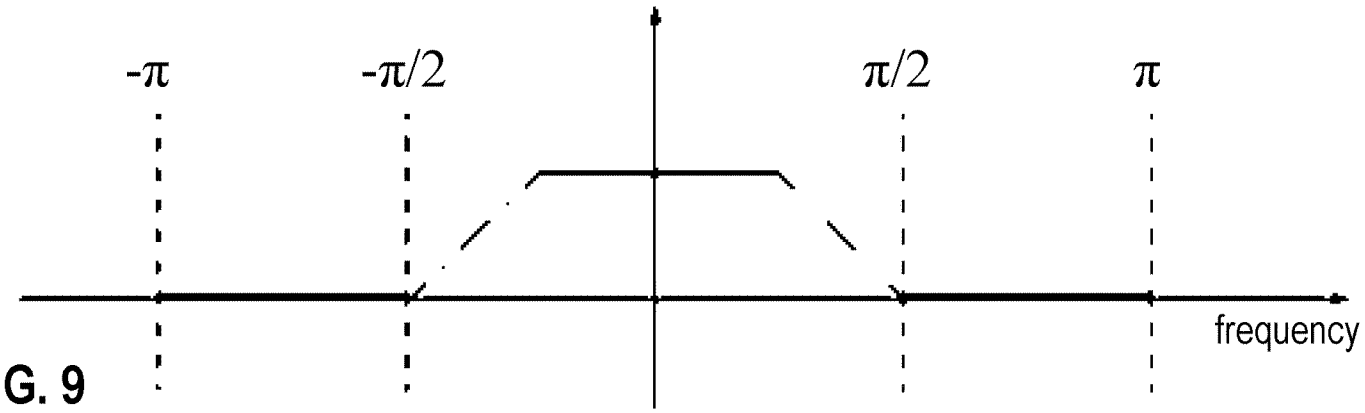
FIG. 9 shows a simplified version of the frequency spectrum of a sub-band signal after shifting to a center frequency of 0.

Initially, in frequency shifter 231, the input signal $v_m(t)$ is shifted to a center frequency of 0, e.g.:

$$\bar{v}_m(t)=v_m(t)e^{j(0-\pi/2)t}=v_m(t)e^{-\pi jt/2}=(-j)^t v_m(t),$$

where $\bar{v}_m(t)$ is the output of the frequency shifter 231. Such a shifting operation involves almost no computational cost, and the spectrum of $\bar{v}_m(t)$ now appears as shown in FIG. 9.

The output of frequency shifter 231 is coupled to the input of up-sampler 232, in which $\bar{v}_m(t)$ preferably is up-sampled by the same factor as the previously performed down-sampling (i.e., M/2 times in the current embodiment), e.g., by inserting zeros. The output of up-sampler 232, in turn, is coupled to the input of lowpass filter (LPF) 233 which has a cutoff frequency above the spectrum of the original signal but below the spectra of the M/2 images, thereby filtering out such M/2 images. The coefficients of LPF 233 preferably are entirely real-valued, and its transition band preferably is within the range of (π/M, 3π/M). Hence, if LPF 233 is implemented as a finite impulse response (FIR) filter, it can be much shorter than the prototype filter for the filter bank.

The output of LPF 233 is coupled to the input of frequency shifter 234, in which the sub-band signal being processed by the current sub-band resynthesis module (module 224A in the current example) is shifted back to its original center frequency, e.g.:

$$\tilde{v}_m(t)=\bar{v}_m(t)e^{jf_m t}=\bar{v}_m(t)e^{j(2m-1)t\pi/2M},$$

where $\tilde{v}_m(t)$ is the output of the frequency shifter 234. Next, in module 235 the imaginary (or quadrature) part of $\tilde{v}_m(t)$ is discarded, and only the real (or in-phase) part of the signal is retained. That is, the output of module 235 preferably is:

$$\text{real}\{\tilde{v}_m(t)\} = \text{real}\left\{\bar{v}_m(t)e^{\frac{j(2m-1)t\pi}{2M}}\right\}$$

The output of module 235 is coupled to the input of resynthesis filter 236, which can be implemented as a conventional resynthesis filter. For instance, resynthesis filter 236 can be a QMF. Finally, as indicated above, the outputs of the resynthesis filters 236, from all the sub-band resynthesis modules (e.g., modules 224A-C), are coupled to the input of adder 225, which sums or combines its input signals to produce a final output signal 250 (y(t)).

As indicated above, in certain embodiments of the invention, use of the Hilbert Transformation module 105 often can provide significant processing advantages over conventional systems. The Hilbert Transformation can be implemented as a FIR or as an infinite impulse response (IIR) filter. If it is implemented as FIR, then the real part of its impulse response function is just a delta function (i.e., single tab). As a result, although the Hilbert Transformation converts a real signal to a complex signal, in terms of the present implementation, it can be as computationally complex as a real-to-real FIR filter with the same or even half of the filter length.

In practical filter-bank designs, down-sampling often is incorporated into the analysis/decomposition filtering, thereby eliminating a separate step and allowing the analysis/decomposition filters to run at a much lower data-rate (and hence, much lower computational complexity), while producing exactly the same output data stream. In addition, in order to maximize the advantage, an alternate embodiment of the present invention includes a modification to the frequency-shifting module 112, described above, to instead perform multiplication every M/2 samples, i.e.:

$$\bar{x}_m(t)\Big|_{t=kM/2} = \tilde{x}_m(t) * e^{j\left(\frac{\pi}{M}-\frac{(2m-1)\pi}{2M}\right)t}\Big|_{t=kM/2}$$

$$\bar{x}_m(t)\Big|_{t=\frac{kM}{2}} = \tilde{x}_m\left(\frac{kM}{2}\right) * e^{j\left(\frac{\pi}{M}-\frac{(2m-1)\pi}{2M}\right)\frac{kM}{2}}$$

$$\bar{x}_m(t)\Big|_{t=\frac{kM}{2}} = \tilde{x}_m\left(\frac{kM}{2}\right) * e^{j\frac{(3-2m)k\pi}{4}}$$

$$\bar{x}_m(t)\Big|_{t=\frac{kM}{2}} = \tilde{x}_m\left(\frac{kM}{2}\right) * e^{j\frac{3k\pi}{4}} * e^{-j\frac{mk\pi}{2}}$$

$$\bar{x}_m(t)\Big|_{t=\frac{kM}{2}} = \tilde{x}_m\left(\frac{kM}{2}\right) * e^{j\frac{3k\pi}{4}} * e^{-j\frac{mk\pi}{2}}$$

$$\bar{x}_m(t)\Big|_{t=\frac{kM}{2}} = \tilde{x}_m\left(\frac{kM}{2}\right) * \left(-\frac{\sqrt{2}}{2} + j\frac{\sqrt{2}}{2}\right)^k * (-j)^{mk}$$

Figure 10:
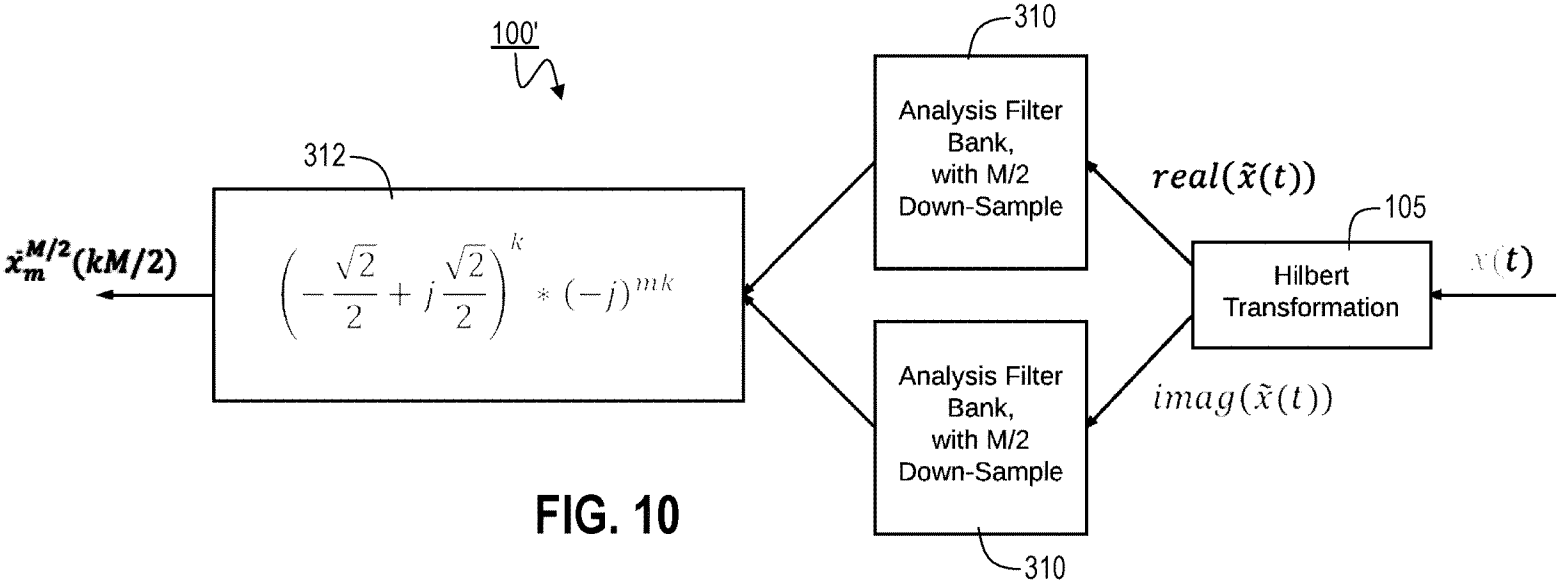
FIG. 10 is a block diagram illustrating an alternate structure for a Hilbert Transformation sub-band analysis/decomposition module according to the present invention.
Figure 11A:
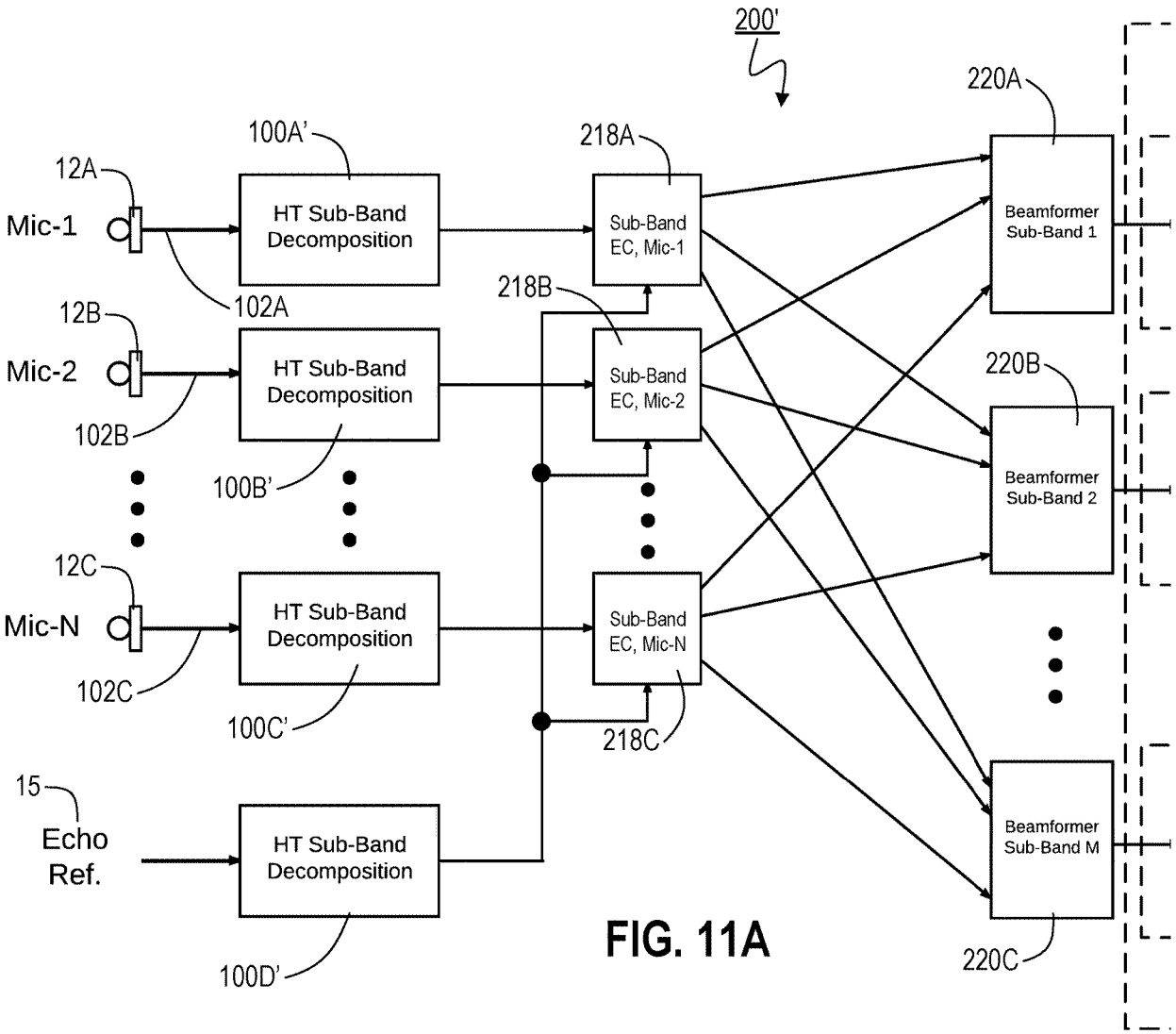
FIG. 11, divided into FIGS. 11A&B in order to more clearly show the individual components, is a block diagram of a system that includes the alternate Hilbert-Transformation sub-band analysis/decomposition modules.
Figure 11B:
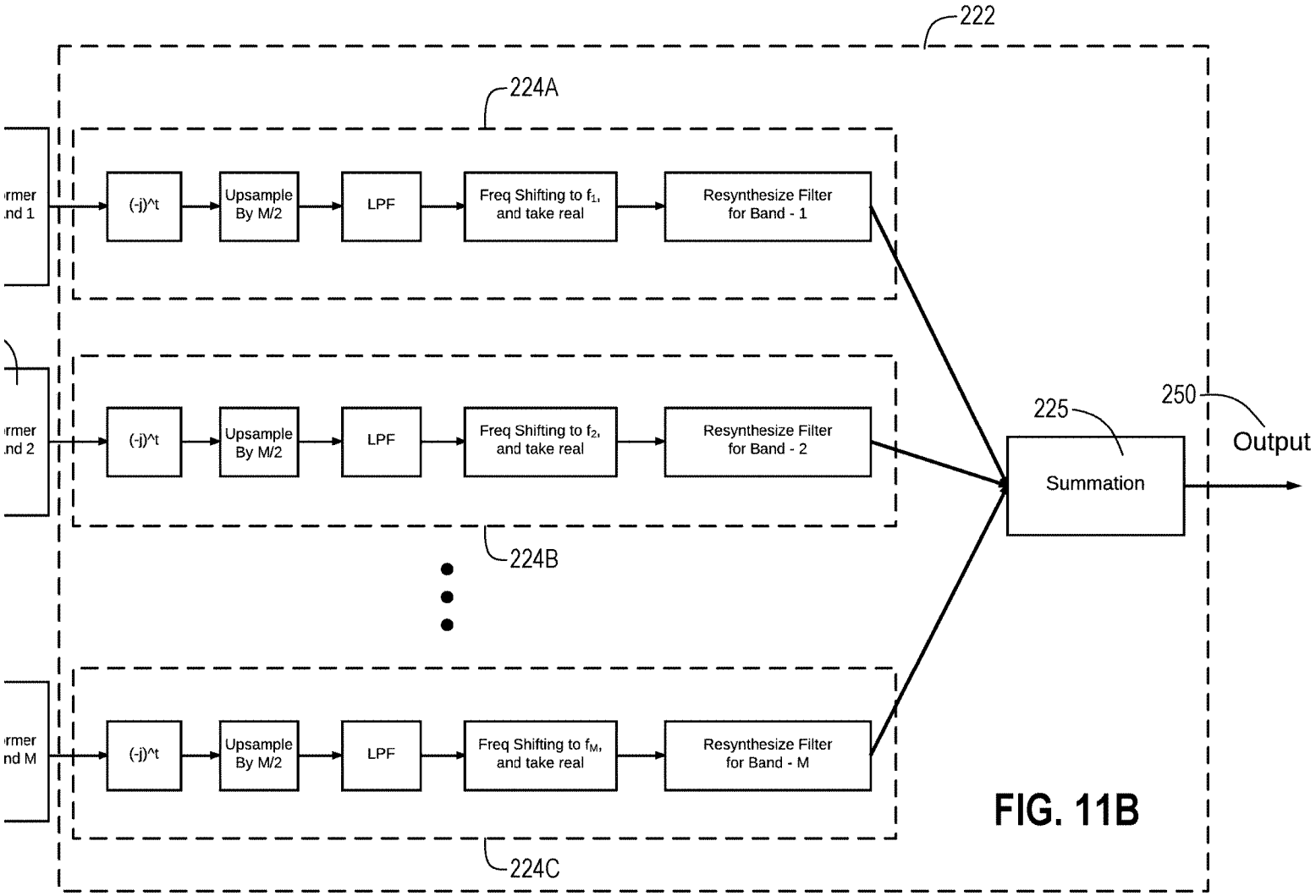

As a result, the HT sub-band analysis/decomposition module 100, described above, can be restructured as module 100', shown in FIG. 10. As should be readily apparent, module 100' typically will be much faster than module 100. Therefore, in a more-preferred embodiment, modules 100, shown in FIG. 7 and referenced in the discussion pertaining to it, are replaced with modules 100' (e.g., modules 100A-D'), as shown in FIG. 11. Otherwise, system 200' is identical to system 200.

Briefly, as shown in FIG. 10, similar to module 100, module 100' also includes a Hilbert Transformation module 105 (described above) with an input coupled to the input signal (x(t)). The real (or in-phase) and imaginary (or quadrature) outputs of module 105 are coupled to separate analysis-and-M/2-down-sampling filter banks 310, which preferably is implemented, e.g., as a conventional analysis/decomposition/down-sampling filter bank in which down-sampling is performed simultaneously with filtering, e.g., using a QMF. The outputs of filter banks 310 are then coupled to inputs of frequency-shifting module 312 which multiplies each sub-sampled complex-valued input $$\left(\text{at time sample}\frac{kM}{2}\right) \text{ by the quantity } \left[\left(-\frac{\sqrt{2}}{2} + j\frac{\sqrt{2}}{2}\right)^k * (-j)^{mk}\right],$$

thereby providing the sub-sampled frequency-shifted output signal $$\left(\bar{x}_m\left(\frac{kM}{2}\right)\right)$$

of module 100'.

The embodiments shown in FIGS. 7 and 11 input audio signals from multiple microphones 12. However, it should be noted that in alternate embodiments, only a single microphone 12 is utilized, in which case only a single microphone HT sub-band analysis/decomposition module 100 or 100' (along with another HT sub-band analysis/decomposition module 100 or 100' for the echo reference signal 15) is provided. Similarly, in such embodiments only a single echo-cancellation module 218 is provided, and its output is coupled to the resynthesis stage 222 without any intervening beamforming module(s) 220.

System Environment.

Generally speaking, except where clearly indicated otherwise, all of the systems, methods, modules, components, functionality and techniques described herein can be practiced with the use of one or more programmable general-purpose computing devices. Such devices (e.g., including any of the electronic devices mentioned herein) typically will include, for example, at least some of the following components coupled to each other, e.g., via a common bus: (1) one or more central processing units (CPUs); (2) read-only memory (ROM); (3) random access memory (RAM); (4) other integrated or attached storage devices; (5) input/output software and circuitry for interfacing with other devices (e.g., using a hardwired connection, such as a serial port, a parallel port, a USB connection or a FireWire connection, or using a wireless protocol, such as radio-frequency identification (RFID), any other near-field communication (NFC) protocol, Bluetooth or a 802.11 protocol); (6) software and circuitry for connecting to one or more networks, e.g., using a hardwired connection such as an Ethernet card or a wireless protocol, such as code division multiple access (CDMA), global system for mobile communications (GSM), Bluetooth, a 802.11 protocol, or any other cellular-based or non-cellular-based system, which networks, in turn, in many embodiments of the invention, connect to the Internet or to any other networks; (7) a display (such as a cathode ray tube display, a liquid crystal display, an organic light-emitting display, a polymeric light-emitting display or any other thin-film display); (8) other output devices (such as one or more speakers, a headphone set, a laser or other light projector and/or a printer); (9) one or more input devices (such as a mouse, one or more physical switches or variable controls, a touchpad, tablet, touch-sensitive display or other pointing device, a keyboard, a keypad, a microphone and/or a camera or scanner); (10) a mass storage unit (such as a hard disk drive or a solid-state drive); (11) a real-time clock; (12) a removable storage read/write device (such as a flash drive, any other portable drive that utilizes semiconductor memory, a magnetic disk, a magnetic tape, an opto-magnetic disk, an optical disk, or the like); and/or (13) a modem (e.g., for sending faxes or for connecting to the Internet or to any other computer network). In operation, the process steps to implement the above methods and functionality, to the extent performed by such a general-purpose computer, typically initially are stored in mass storage (e.g., a hard disk or solid-state drive), are downloaded into RAM, and then are executed by the CPU out of RAM. However, in some cases the process steps initially are stored in RAM or ROM and/or are directly executed out of mass storage.

Suitable general-purpose programmable devices for use in implementing the present invention may be obtained from various vendors. In the various embodiments, different types of devices are used depending upon the size and complexity of the tasks. Such devices can include, e.g., mainframe computers, multiprocessor computers, one or more server boxes, workstations, personal (e.g., desktop, laptop, tablet or slate) computers and/or even smaller computers, such as personal digital assistants (PDAs), wireless telephones (e.g., smartphones) or any other programmable appliance or device, whether stand-alone, hard-wired into a network or wirelessly connected to a network.

In addition, although general-purpose programmable devices can be used in the systems described above, in alternate embodiments one or more special-purpose processors or computers instead (or in addition) are used. In general, it should be noted that, except as expressly noted otherwise, any of the functionality described above can be implemented by a general-purpose processor executing software and/or firmware, by dedicated (e.g., logic-based) hardware, or any combination of these approaches, with the particular implementation being selected based on known engineering tradeoffs. More specifically, where any process and/or functionality described above is implemented in a fixed, predetermined and/or logical manner, it can be accomplished by a processor executing programming (e.g., software or firmware), an appropriate arrangement of logic components (hardware), or any combination of the two, as will be readily appreciated by those skilled in the art. In other words, it is well-understood how to convert logical and/or arithmetic operations into instructions for performing such operations within a processor and/or into logic gate configurations for performing such operations; in fact, compilers typically are available for both kinds of conversions.

It should be understood that the present invention also relates to machine-readable tangible (or non-transitory) media on which are stored software or firmware program instructions (i.e., computer-executable process instructions) for performing the methods and functionality and/or for implementing the modules and components of this invention. Such media include, by way of example, magnetic disks, magnetic tape, optically readable media such as CDs and DVDs, or semiconductor memory such as various types of memory cards, USB flash memory devices, solid-state drives, etc. In each case, the medium may take the form of a portable item such as a miniature disk drive or a small disk, diskette, cassette, cartridge, card, stick etc., or it may take the form of a relatively larger or less-mobile item such as a hard disk drive, ROM or RAM provided in a computer or other device. As used herein, unless clearly noted otherwise, references to computer-executable process steps stored on a computer-readable or machine-readable medium are intended to encompass situations in which such process steps are stored on a single medium, as well as situations in which such process steps are stored across multiple media.

The foregoing description primarily emphasizes electronic computers and devices. However, it should be understood that any other computing or other type of device instead may be used, such as a device utilizing any combination of electronic, optical, biological and chemical processing that is capable of performing basic logical and/or arithmetic operations.

In addition, where the present disclosure refers to a processor, computer, server, server device, computer-readable medium or other storage device, client device, or any other kind of apparatus or device, such references should be understood as encompassing the use of plural such processors, computers, servers, server devices, computer-readable media or other storage devices, client devices, or any other such apparatuses or devices, except to the extent clearly indicated otherwise. For instance, a server generally can (and often will) be implemented using a single device or a cluster of server devices (either local or geographically dispersed), e.g., with appropriate load balancing. Similarly, a server device and a client device often will cooperate in executing the process steps of a complete method, e.g., with each such device having its own storage device(s) storing a portion of such process steps and its own processor(s) executing those process steps.

Additional Considerations.

As used herein, the term "coupled", or any other form of the word, is intended to mean either directly connected or connected through one or more other elements or processing blocks, e.g., for the purpose of preprocessing. In the drawings and/or the discussions of them, where individual steps, modules or processing blocks are shown and/or discussed as being directly connected to each other, such connections should be understood as couplings, which may include additional steps, modules, elements and/or processing blocks. Unless otherwise expressly and specifically stated otherwise herein to the contrary, references to a signal herein mean any processed or unprocessed version of the signal. That is, specific processing steps discussed and/or claimed herein are not intended to be exclusive; rather, intermediate processing may be performed between any two processing steps expressly discussed or claimed herein.

As used herein, the term "attached", or any other form of the word, without further modification, is intended to mean directly attached, attached through one or more other intermediate elements or components, or integrally formed together. In the drawings and/or the discussion, where two individual components or elements are shown and/or discussed as being directly attached to each other, such attachments should be understood as being merely exemplary, and in alternate embodiments the attachment instead may include additional components or elements between such two components. Similarly, method steps discussed and/or claimed herein are not intended to be exclusive; rather, intermediate steps may be performed between any two steps expressly discussed or claimed herein.

In the preceding discussion, the terms "operators", "operations", "functions" and similar terms refer to process steps or hardware components, depending upon the particular implementation/embodiment.

In the event of any conflict or inconsistency between the disclosure explicitly set forth herein or in the accompanying drawings, on the one hand, and any materials incorporated by reference herein, on the other, the present disclosure shall take precedence. In the event of any conflict or inconsistency between the disclosures of any applications or patents incorporated by reference herein, the disclosure most recently added or changed shall take precedence.

Unless clearly indicated to the contrary, words such as "optimal", "optimize", "maximize", "minimize", "best", as well as similar words and other words and suffixes denoting comparison, in the above discussion are not used in their absolute sense. Instead, such terms ordinarily are intended to be understood in light of any other potential constraints, such as user-specified constraints and objectives, as well as cost and processing or manufacturing constraints.

In the above discussion, certain processes and/or methods are explained by breaking them down into functions or steps listed in a particular order. However, it should be noted that in each such case, except to the extent clearly indicated to the contrary or mandated by practical considerations (such as where the results from one function or step are necessary to perform another), the indicated order is not critical but, instead, that the described functions and steps can be reordered and/or two or more of such steps can be performed concurrently.

References herein to a "criterion", "multiple criteria", "condition", "conditions" or similar words which are intended to trigger, limit, filter or otherwise affect processing steps, other actions, the subjects of processing steps or actions, or any other activity or data, are intended to mean "one or more", irrespective of whether the singular or the plural form has been used. For instance, any criterion or condition can include any combination (e.g., Boolean combination) of actions, events and/or occurrences (i.e., a multi-part criterion or condition).

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

In the discussions above, the words "include", "includes", "including", and all other forms of the word should not be understood as limiting, but rather any specific items following such words should be understood as being merely exemplary.

Several different embodiments of the present invention are described above and in the document(s) incorporated by reference herein, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the intent and the scope of the invention. Accordingly, the invention is not limited to the precise embodiments shown in the drawings and described above. Rather, it is intended that all such variations not departing from the intent of the invention are to be considered as within the scope thereof as limited solely by the claims appended hereto.

What is claimed is:

1. An audio-signal-processing system, comprising:

a plurality of Hilbert Transform (HT) sub-band analysis/decomposition modules, each including (a) a Hilbert Transformation module having an input and an output that provides a Hilbert Transformed version of a signal at the input of said Hilbert Transformation module; and (b) an analysis/decomposition filter bank having (i) an input coupled to the output of the Hilbert Transformation module and (ii) a plurality of outputs, each providing a different frequency sub-band for a signal provided at the input of said analysis/decomposition filter bank; and a plurality of echo-cancellation modules, each having (i) a first set of sub-band inputs coupled to corresponding sub-band outputs of a unique one of the HT sub-band analysis/decomposition modules, (ii) a second set of sub-band inputs coupled to corresponding sub-band outputs of one of the HT sub-band analysis/decomposition modules that is common across said echo-cancellation modules, and (iii) sub-band outputs that result from performing echo-cancellation processing on said said first set of sub-band inputs, using said second set of sub-band inputs as reference signals;

a plurality of beamforming modules, each having a plurality of inputs and an output, wherein for each said beamforming module, the inputs of said beamforming module are coupled to a same one of the sub-bands output from different ones of said echo-cancellation modules, and the output of said beamforming module provides the same one of the sub-bands after beamforming; and a resynthesis stage, having inputs coupled to the different sub-band outputs of the different beamforming modules, which resynthesizes said different sub-band outputs of said different beamforming modules in order to provide a system output signal.

2. An audio-signal-processing system according to claim 1, further comprising a plurality of microphones coupled to inputs of said plurality of HT sub-band analysis/decomposition modules.

3. An audio-signal-processing system according to claim 2, further comprising an echo reference signal coupled to an input of said common one of the plurality of HT sub-band analysis/decomposition modules.

4. An audio-signal-processing system according to claim 1, wherein said resynthesis stage comprises (i) a plurality of sub-band resynthesis modules, each having an input coupled to the output of a different one of said beamforming modules and an output, and (ii) an adder having inputs coupled to the outputs of the sub-band resynthesis modules and an output coupled to an output of said resynthesis stage.

5. An audio-signal-processing system according to claim 4, wherein each of said sub-band resynthesis modules comprises a first frequency shifter that shifts a current sub-band to a center frequency of 0, followed by an up-sampler, followed by a low-pass filter, followed by a second frequency shifter that shifts a baseband signal back to an original center frequency of the current sub-band, followed by a resynthesis filter.

6. An audio-signal-processing system according to claim 5, wherein only an in-phase portion of a signal output by said second frequency shifter is coupled to said resynthesis filter.

7. An audio-signal-processing system according to claim 1, wherein said HT sub-band analysis/decomposition modules also shift individual sub-bands to a different center frequency and perform down-sampling.

8. An audio-signal-processing system according to claim 7, wherein said down-sampling is by a factor of M/2, with M being a total number of different sub-bands provided by said analysis/decomposition filter bank.

9. An audio-signal-processing system according to claim 7, wherein said different center frequency is a common frequency across all of said HT sub-band analysis/decomposition modules.

10. An audio-signal-processing system according to claim 9, wherein said common frequency is $\pi/M$.

11. An audio-signal-processing system according to claim 1, wherein said Hilbert Transformation module provides an in-phase output signal that is coupled to said analysis/decomposition filter bank and a quadrature output signal that is coupled to a second analysis/decomposition filter bank.

12. An audio-signal-processing system according to claim 11, wherein said analysis/decomposition filter bank and said second analysis/decomposition filter bank simultaneously perform filtering and down-sampling.

13. An audio-signal-processing system according to claim 12, wherein said down-sampling is performed at a factor of M/2, with M being a total number of different sub-bands provided by said analysis/decomposition filter bank and said second analysis/decomposition filter bank.

14. An audio-signal-processing system according to claim 13, wherein outputs of said analysis/decomposition filter bank and said second analysis/decomposition filter bank are coupled to a frequency-shifting module.

15. An audio-signal-processing system according to claim 14, wherein said frequency-shifting module shifts the sub-bands to a common center frequency.

16. An audio-signal-processing system according to claim 14, wherein the frequency-shifting module multiplies complex-valued input values at time samples $$\frac{kM}{2}$$

within each sub-band m by a factor of $$\left[\left(-\frac{\sqrt{2}}{2}+j\frac{\sqrt{2}}{2}\right)^{k}*(-j)^{mk}\right].$$

* * * * *